United States Patent [19]

Shu et al.

[11] 4,428,819

[45] Jan. 31, 1984

[54] HYDROISOMERIZATION OF CATALYTICALLY DEWAXED LUBRICATING OILS

[75] Inventors: Paul Shu, Princeton Junction, N.J.; Tsoung-Yuan Yan, Philadelphia, Pa.

[73] Assignee: Mobil Oil Corporation, New York, N.Y.

[21] Appl. No.: 400,831

[22] Filed: Jul. 22, 1982

[51] Int. Cl.[3] ..... C10G 47/00

[52] U.S. Cl. ..... 208/46; 208/111

[58] Field of Search ..... 208/46, 111

[56] References Cited

U.S. PATENT DOCUMENTS

| | | | |
|---|---|---|---|
| Re. 28,398 | 4/1975 | Chen et al. | 208/111 |
| 2,779,713 | 1/1957 | Cole et al. | 208/57 |
| 2,817,693 | 12/1957 | Koome et al. | 208/46 |
| 3,308,052 | 3/1967 | Ireland et al. | 208/139 |
| 3,658,689 | 4/1972 | Steinmetz et al. | 208/46 |
| 3,668,113 | 6/1972 | Burbidge et al. | 208/111 |
| 3,700,585 | 10/1972 | Chen et al. | 208/111 |
| 4,181,598 | 1/1980 | Gillespie et al. | 208/58 |
| 4,357,232 | 11/1982 | Holland et al. | 208/89 |

*Primary Examiner*—Curtis R. Davis

*Attorney, Agent, or Firm*—Alexander J. McKillop; Michael G. Gilman; Richard D. Stone

[57] ABSTRACT

The quality of catalytically hydrodewaxed oils is improved by hydroisomerizing the oil to remove residual waxy components which contribute to poor performance in the Overnight Cloud Point test. Conversion during the hydroisomerization is minimized so as to obtain a product of high clarity in good yield.

6 Claims, No Drawings

HYDROISOMERIZATION OF CATALYTICALLY DEWAXED LUBRICATING OILS

FIELD OF THE INVENTION

The present invention relates to a method of hydrofinishing catalytically hydrodewaxed lubricating oil stocks (lube oil) by the hydroisomerization of the residual wax content which has not been removed by the dewaxing process.

BACKGROUND OF THE INVENTION

Catalytic dewaxing of hydrocarbon oils to reduce the temperature at which separation of waxy hydrocarbons occurs is a known process and is described, for example, in the Oil and Gas Journal, Jan. 6, 1975, pages 69–73. A number of patents have also described catalytic dewaxing processes, for example, U.S. Pat. No. Re. 28,398 describes a process for catalytic dewaxing with a catalyst comprising a zeolite of the ZSM-5 type and a hydrogenation/dehydrogenation component. A process for hydrodewaxing a gas oil with a ZSM-5 type catalyst is also described in U.S. Pat. No. 3,956,102. A mordenite catalyst containing a Group VI or a Group VIII metal may be used to dewax a low V.I. distillate from a waxy crude, as described in U.S. Pat. No. 4,100,056. U.S. Pat. No. 3,755,138 describes a process for mild solvent dewaxing to remove high quality wax from a lube stock, which is then catalytically dewaxed to specification pour point.

Catalytic dewaxing processes may be followed by other processing steps such as hydrodesulfurization and denitrogenation in order to improve the qualities of the product. For example, U.S. Pat. No. 3,668,113 describes a catalytic dewaxing process employing a mordenite dewaxing catalyst which is followed by a catalytic hydrodesulfurization step over an alumina-based catalyst. U.S. Pat. No. 3,894,938 describes a hydrodewaxing process using a ZSM-5 type catalyst which is followed by conventional hydrodesulfurization of the dewaxed intermediate.

In catalytic dewaxing processes using shape selective catalysts such as ZSM-5, the waxy components particularly the n-paraffins, are cracked by the zeolite into light gases, such as $C_1$ and $C_3$ and some heavier olefinic fragments which remain in the lube oil boiling range. These olefinic fragments are unstable to oxidation so that the hydrodewaxed oil is subsequently hydrogenated over catalyst to saturate the olefins and improve the oxidation stability of the oil. The hydrogenation catalysts generally used are mild hydrogenation catalysts such as $CoMo/Al_2O_3$ type. The color of the oil may also be improved in this hydrofinishing.

The waxy components in heavy lube fractions, particularly bright stock, contain not only the normal paraffins, but also slightly branched paraffins and cycloparaffins. In the bright stock, the normal paraffins comprise the so-called microcrystalline wax while the slightly branched paraffins and cycloparaffins comprise so-called petrolatum wax. When a shape selective catalyst such as HZSM-5 is used, the microcrystalline wax cracks much faster than the petroleum wax. As a result, when sufficient microcrystalline wax is cracked (e.g. 99+%) to meet the pour point requirement of say, −7° C., there is still some petrolatum wax left, say, 0.5 to 5%. This small amount of petrolatum wax does not impair pour point specification but it makes the oil fail an overnight cloud point (ONC) test (ASTM D-2500-66).

The overnight cloud point test is conducted by placing the finished oil overnight in a refrigerator set at 5.5° C. (10° F.) above the pour point specified, say −7° (about 20° F.). An oil sample passes the test if it remains clear and bright, but some oils, particularly hydrodewaxed oil become dull due to growth of wax crystals, and fail the test. The oil fails the overnight cloud test as soon as the wax crystals nucleate and grow to sufficient sizes of say, 0.05 to 0.5 microns.

If the severity of the dewaxing is increased significantly, the product can be made to meet the overnight cloud point (ONC) test. For instance, decreasing the product pour point to −23° C. (−10° F.) by increasing temperature, decreasing space velocity, etc., can produce a product that passes the ONC test at −1° C. (30° F.). However, this decrease in pour point leads to increased cost (because of reaction severity) and, particularly, to decreased yield.

It would therefore be desirable to find some way of improving the quality of the catalytically dewaxed product so that it is capable of passing the ONC test without incurring the disadvantages of a higher severity dewaxing and, in particular, to avoid the losses in yield concomitant upon such a treatment.

SUMMARY OF THE INVENTION

We have now found that much of the petrolatum wax can be converted to more soluble isomers by hydroisomerization under mild conditions with little loss in yield. This treatment results in a product which has a markedly improved overnight cloud point i.e. a lower cloud point temperature. The hydrofinished products are also characterized by improved oxidation stability and relative freedom from color bodies. These improvements are obtained, moreover, with only minimal losses in the yield of the finished oil.

According to the present invention, there is therefore provided a process for hydrofinishing a catalytically dewaxed oil in which the residual wax content of the dewaxed oil is isomerized over a hydroisomerization catalyst. The catalyst used in this process is a bifunctional catalyst having both hydrogenation and acidic activities. The acidic functionality may be provided by an amorphous material such as alumina or silica-alumina or, more preferably, by a crystalline zeolite. The hydrogenation component will be a metal such as platinum, palladium, nickel, cobalt or molybdenum or a mixture of these metals.

The isomerization is carried out in the presence of hydrogen under isomerization conditions of elevated temperature and pressure, typically from 200° C. to 450° C. (about 400° F. to 840° F.), 400 to 25,000 kPa (about 50 to 3625 psig) with space velocities of 0.1 to 10 $hr^{-1}$ LHSV.

PREFERRED EMBODIMENTS OF THE INVENTION

Feedstock

The feedstock for the present isomerization process is a catalytically dewaxed oil which typically has a boiling point above the distillate range i.e. above about 345° C. (650° F.). Products of this kind are lubricating (lube) oil stocks which possess a characteristically low content of n-paraffins but with residual small quantities of slightly branched chain paraffins and cycloparaffins which are responsible for unacceptable results in the ONC test. The content of these petrolatum waxes is typically in the range 0.5 to 5 percent by weight of the oil but slightly higher or lower contents may be encountered, depending upon the nature of the feedstock to the dewaxing step and the conditions (catalyst severity) used in the dewaxing. Typical boiling ranges for lube stocks will be over 345° C. depending upon the grades.

The present process is applicable to stocks other than lube stocks when a low wax content is desired in the final product and, in particular, when a product passing a test similar to ONC is desired. Thus, the process may also be applied to catalytically dewaxed distillate range materials such as heating oils, jet fuels and diesel fuels.

The catalytically dewaxed oil may be produced by any kind of catalytic dewaxing process, for example, processes of the kind described in U.S. Pat. Nos. 3,668,113 and 4,110,056 but is especially useful with oils produced by dewaxing processes using shape selective catalysts such as ZSM-5 or ZSM-11, ZSM-23, ZSM-35, or ZSM-38. Dewaxing processes using catalysts of this kind are described, for example, in U.S. Pat. Nos. Re. 28,398, 3,956,102, 3,755,138 and 3,894,938 to which reference is made for details of such processes. Since dewaxing processes of this kind are invariably operated in the presence of hydrogen they are frequently referred to as hydrodewaxing processes and, for this reason, the dewaxed oil may be obtained from a process which may be described either as catalytic dewaxing or catalytic hydrodewaxing. For convenience, the term "catalytic dewaxing" will be used in this specification to cover both designations. When used in combination with the present hydrofinishing process, the catalytic dewaxing step need not be operated at such severe conditions as would formerly have been necessary in order to meet all product specifications—especially the pour point and the ONC specification—because the present process will improve the quality of the product and, in particular, will improve its pour point and ONC performance and stability. However, if desired, the catalytically dewaxed oil may be hydrodesulfurized or denitrogenated prior to the present hydrofinishing step in order to remove heterocyclic contaminants which might otherwise adversely affect catalyst performance. Hydrotreating steps of this kind are described, for example, in U.S. Pat. Nos. 3,668,113 and 3,894,938 to which reference is made for details of these steps.

Catalysts

The catalysts used in the present hydrofinishing process are hydroisomerization catalysts which comprise an acidic component and a hydrogenation-dehydrogenation component (referred to, for convenience, as a hydrogenation component) which is generally a metal or metals of Groups IB, IIB, VA, VIA or VIIIA of the Periodic Table (IUPAC and U.S. National Bureau of Standards approved Table as shown, for example, in the Chart of the Fisher Scientific Company, Catalog No. 5-702-10). The preferred hydrogenation components are the noble metals of Group VIIIA, especially platinum but other noble metals such as palladium, gold, silver, rhenium or rhodium may also be used. Combinations of noble metals such as platinum-rhenium, platinum-palladium, platinum-iridium or platinum-iridium-rhenium together with combinations with non-noble metals, particularly of Groups VIA and VIIIA are of interest, particularly with metals such as cobalt, nickel, vanadium, tungsten, titanium and molybdenum, for example, platinum-tungsten, platinum-nickel or platinum-nickel-tungsten. Base metal hydrogenation components may also be used, especially nickel, cobalt, molybdenum, tungsten, copper or zinc. Combinations of base metals such as cobalt-nickel, cobalt-molybdenum, nickel-tungsten, cobalt-nickel-tungsten or cobalt-nickel-titanium may also be used. Because the isomerization which is desired is favored by strong hydrogenation activity in the catalyst, the more active noble metals such as platinum and palladium will normally be preferred over the less active base metals.

The metal may be incorporated into the catalyst by any suitable method such as impregnation or exchange onto the zeolite. The metal may be incorporated in the form of a cationic, anionic or neutral complex, such as $Pt(NH_3)_4^{2+}$, and cationic complexes of this type will be found convenient for exchanging metals onto the zeolite. Anionic complexes are also useful for impregnating metals into the zeolites.

The amount of the hydrogenation-dehydrogenation component is suitably from 0.01 to 10 percent by weight, normally 0.1 to 5 percent by weight, although this will, of course, vary with the nature of the component, less of the highly active noble metals, particularly platinum, being required than of the less active metals.

The acidic component of the zeolite may be porous amorphous material such as an acidic clay, alumina, or silica-alumina but the porous, crystalline zeolites are preferred. The crystalline zeolite catalysts used in the catalyst comprise a three dimensional lattice of $SiO_4$ tetrahedra crosslinked by the sharing of oxygen atoms and which may optionally contain other atoms in the lattice, especially aluminum in the form of $AlO_4$ tetrahedra; the zeolite will also include a sufficient cationic complement to balance the negative charge on the lattice. Zeolites have a crystal structure which is capable of regulating the access to an egress from the intracrystalline free space. This control, which is effected by the crystal structure itself, is dependent both upon the molecular configuration of the material which is or, alternatively, is not, to have access to the internal structure of the zeolite and also upon the structure of the zeolite itself. The pores of the zeolite are in the form of rings which are formed by the regular disposition of the tetrahedra making up the anionic framework of the crystalline aluminosilicate, the oxygen atoms themselves being bonded to the silicon or aluminum atoms at the centers of the tetrahedra. A convenient measure of the extent to which a zeolite provides this control for molecules of varying sizes to its internal structure is provided by the Constraint Index of the zeolite: zeolites which provide but highly restricted access to and egress from the internal structure have a high value for the Constraint Index and zeolites of this kind usually have pores of small size. Contrariwise, zeolites which provide relatively free access to the internal zeolite structure have a low value for the Constraint Index. The method by which Constraint Index is determined is described fully in U.S. Pat. No. 4,016,218 to which reference is made for details of the method together with examples of Constraint Index for some typical zeolites. Because Constraint Index is related to the crystalline structure of the zeolite but is nevertheless determined by means of a test which exploits the capacity of the zeolite to engage in a cracking reaction, that is, a reaction dependent upon the possession of acidic sites and functionality in the zeolite, the sample of zeolite used in the test should be representative of zeolitic structure whose Constraint Index is to be determined and should also possess requisite acidic functionality for the test. Acidic functionality may, of course, be varied by artifices including base exchange, steaming or control of silica:alumina ratio.

A wide variety of acidic zeolites may be used in the present including large pore zeolites such as natural faujasite, mordenite, zeolite X, zeolite Y, ZSM-20 and zeolite beta, small pore zeolites such as zeolite A and zeolites which are characterized by a Constraint Index from 1 to 12 and a silica:alumina ratio of at least 12:1. Specific zeolites having a Constraint Index of 1 to 12 and silica:alumina ratio include ZSM-5, ZSM-11, ZSM-12, ZSM-35 and ZSM-38 which are disclosed, respectively, in U.S. Pat. Nos. 3,702,886; 3,709,979; 3,832,449; 4,016,245 and 4,046,859. Of them, ZSM-5 is preferrred. Highly siliceous forms of ZSM-11 are described in European Patent Publication No. 14059 and of ZSM-12 in European Patent Publication No. 13630. Reference is made to these patents and applications for details of these zeolites and their preparation.

The silica:alumina ratios referred to in this specification are the structural or framework ratios, that is, the ratio for the $SiO_4$ to the $AlO_4$ tetrahedra which together constitute the structure of which the zeolite is composed. This ratio may vary from the silica:alumina ratio determined by various physical and chemical methods. For example, a gross chemical analysis may include aluminum which is present in the form of cations associated with the acidic sites on the zeolite, thereby giving a low silica:alumina ratio. Similarly, if the ratio is determined by thermogravimetric analysis (TGA) of ammonia desorption, a low ammonia titration may be obtained if cationic aluminum prevents exchange of the ammonium ions onto the acidic sites. These disparities are particularly troublesome when certain treatments such as the dealuminization methods described below which result in the presence of ionic aluminum free of the zeolite structure are employed. Due care should therefore be taken to ensure that the framework silica:alumina ratio is correctly determined.

Large pore zeolites such as zeolites Y, ZSM-20 and beta are useful in the present process. Zeolites of this kind will normally have a Constraint Index of less than 1. They may be used on their own or in combination with a zeolite having a Constraint Index of 1 to 12 and such combinations may produce particularly desirable results. A combination of zeolites Y and ZSM-5 has been found to be especially good.

Zeolite beta is disclosed in U.S. Pat. No. 3,308,069 to which reference is made for details of this zeolite and its preparation (the disclosures of materials to which reference is made in this specification are incorporated by those references).

When the zeolites have been prepared in the presence of organic cations they are catalytically inactive, possibly because the intracrystalline free space is occupied by organic cations from the forming solution. They may be activated by heating in an inert atmosphere at 540° C. for one hour, for example, followed by base exchange with ammonium salts followed by calcination at 540° C. in air. The presence of organic cations in the forming solution may not be absolutely essential to the formation of the zeolite; but it does appear to favor the formation of this special type of zeolite.

Some natural zeolites may sometimes be converted to zeolites of the desired type by various activation procedures and other treatments such as base exchange, steaming, alumina extraction and calcination.

When synthesized in the alkali metal form, the zeolite is conveniently converted to the hydrogen form, generally by intermediate formation of the ammonium form as a result of ammonium ion exchange and calcination of the ammonium form to yield the hydrogen form. It has been found that although the hydrogen form of the zeolite catalyzes the reaction successfully, the zeolite may also be partly in the alkali metal form although the selectivity to alpha-picoline is lower with the zeolite in this form.

It may be desirable to incorporate the zeolite in another material resistant to the temperature and other conditions employed in the process. Such matrix materials include synthetic or naturally occurring or in the form of gelatinous precipitates or gels including mixtures of silica and metal oxides. Naturally occurring clays can be composited with the zeolite and they may be used in the raw state as originally mined or initially subjected to calcination, acid treatment or chemical modification. Alternatively, the zeolite may be composited with a porous matrix material, such as alumina, silica-alumina, silica-magnesia, silica-zirconia, silica-thoria, silica-berylia, silica-titania as well as ternary compositions, such as silica-alumina-thoria, silica-alumina-zirconia, silica-alumina-magnesia or silica-magnesia-zirconia. The matrix may be in the form of a cogel. The relative proportions of zeolite component and inorganic oxide gel matrix may vary widely with the zeolite content typically ranging from 1 to 99 percent by weight and more usually in the range of 5 to 80 percent weight of the composite. The matrix itself may have catalytic properties of an acidic nature which may contribute to the functionality of the catalyst. Zeolites may also be combined with amorphous catalysts and other porous materials such as alumina. The combination of zeolites Y and ZSM-5 with alumina has been found to be particularly desirable.

The isomerization reaction is one which requires a relatively small degree of acidic functionality in the catalyst. Because of this, the zeolite may have a very high silica:alumina ratio since this ratio is inversely related to the acid site density of the catalyst. Thus, structural silica:alumina ratios of 50:1 or higher are preferred and in fact the ratio may be much higher e.g. 100:1, 200:1, 500:1, 1000:1 or even higher. Since zeolites are known to retain their acidic functionality even at very high silica:alumina ratios of the order of 25,000:1, ratios of this magnitude or even higher are contemplated.

If the zeolite selected may be produced in the desired highly siliceous form by direct synthesis, this will often be the most convenient method for obtaining it. Zeolite beta, for example, is known to be capable of being synthesized directly in forms having silica:alumina ratios up to 100:1, as described in U.S. Pat. Nos. 3,308,069 and Re. 28,341 which describe zeolite beta, its preparation and properties in detail. Reference is made to these patents for these details. Zeolite Y, on the other hand, can be synthesized only in forms which have silica:alumina ratios up to about 5:1 and in order to achieve higher ratios, resort may be made to various techniques to remove structural aluminum so as to obtain a more highly siliceous zeolite. The same is true of mordenite which, in its natural or directly synthesized form has a silica:alumina ratio of about 10:1. Zeolite ZSM-20 may be directly synthesized with silica:alumina ratios of 7:1 or higher, typically in the range of 7:1 to 10:1, as described in U.S. Pat. Nos. 3,972,983 and 4,021,331 to which reference is made for details of this zeolite, its preparation and properties. Zeolite ZSM-20 also may be treated by various methods to increase its silica:alumina ratio.

Control of the silica:alumina ratio of the zeolite in its as-synthesized form may be exercised by an appropriate selection of the relative proportions of the starting materials, especially the silica and alumina precursors, a relatively smaller quantity of the alumina precursor resulting in a higher silica:alumina ratio in the product zeolite, up to the limit of the synthetic procedure. If higher ratios are desired and alternative syntheses affording the desired high silica:alumina ratios are not available, other techniques such as those described below may be used in order to prepare the desired highly siliceous zeolites.

A number of different methods are known for increasing the structural silica:alumina ratio of various zeolites. Many of these methods rely upon the removal of aluminum from the structural framework of the zeolite by chemical agents appropriate to this end. A considerable amount of work on the preparation of aluminum deficient faujasites has been performed and is reviewed in Advances in Chemistry Series No. 121, Molecular Sieves, G. T. Kerr, American Chemical Society, 1973. Specific methods for preparing dealuminized zeolites are described in the following, and reference is made to them for details of the method: Catalysis by Zeolites (International Symposium on Zeolites, Lyon, Sept. 9–11, 1980), Elsevier Scientific Publishing Co., Amsterdam, 1980 (dealuminization of zeolite Y with silicon tetrachloride); U.S. Pat. No. 3,442,795 and G.B. Pat. No. 1,058,188 (hydrolysis and removal of aluminum by chelation); G.B. Pat. No. 1,061,847 (acid extraction of aluminum); U.S. Pat. No. 3,493,519 (aluminum removal by steaming and chelation); U.S. Pat. No. 3,591,488 (aluminum removal by steaming); U.S. Pat. No. 4,273,753 (dealuminization by silicon halides and oxyhalides); U.S. Pat. No. 3,691,099 (aluminum extraction with acid); U.S. Pat. No. 4,093,560 (dealuminization by treatment with salts); U.S. Pat. No. 3,937,791 (aluminum removal with Cr(III) solutions); U.S. Pat. No. 3,506,400 (steaming followed by chelation); U.S. Pat. No. 3,640,681 (extraction of aluminum with acetylacetonate followed by dehydroxylation); U.S. Pat. No. 3,836,561 (removal of aluminum with acid); DE-OS No. 2,510,740 (treatment of zeolite with chlorine or chlorine-contrary gases at high temperatures), NL Pat. No. 7,604,264 (acid extraction), JA Pat. No. 53,101,003 (treatment with EDTA or other materials to remove aluminum) and J. Catalysis 54 295 (1978) (hydrothermal treatment followed by acid extraction).

Because of their convenience and practicality the preferred dealuminization methods for preparing the present highly siliceous zeolites are those which rely upon acid extraction of the aluminum from the zeolite by contacting the zeolite with an acid, preferably a mineral acid such as hydrochloric acid. With zeolite beta the dealuminization proceeds readily at ambient and mildly elevated temperatures and occurs with minimal losses in crystallinity, to form high silica forms of zeolite beta with silica:alumina ratios of at least 100:1, with ratios of 200:1 or even higher being readily attainable.

Highly siliceous forms of zeolite Y may be prepared steaming or by acid extraction of structural aluminum (or both) but because zeolite Y in its normal, as-synthesized condition, is unstable to acid, it must first be converted to an acid-stable form. Methods for doing this are known and one of the most common forms of acid-resistant zeolite Y is known as "Ultrastable Y" (USY); it is described in U.S. Pat. Nos. 3,293,192 and 3,402,996 and the publication, Society of Chemical Engineering (London) Monograph Molecular Sieves, page 186 (1968) by C. V. McDaniel and P. K. Maher, and reference is made to these for details of the zeolite and its preparation. In general, "ultrastable" refers to Y-type zeolite which is highly resistant to degradation of crystallinity by high temperature and steam treatment and is characterized by a $R_2O$ content (wherein R is Na, K or any other alkali metal ion) of less than 4 weight percent, preferably less than 1 weight percent, and a unit cell size less than 24.5 Angstroms and a silica to alumina mole ratio in the range of 3.5 to 7 or higher. The ultrastable form of Y-type zeolite is obtained primarily by a substantial reduction of the alkali metal ions and the unit cell size reduction of the alkali metal ions and the unit cell size reduction. The ultrastable zeolite is identified both by the smaller unit cell and the low alkali metal content in the crystal structure.

The ultrastable form of the Y-type zeolite can be prepared by successively base exchanging a Y-type zeolite with an aqueous solution of an ammonium salt, such as ammonium nitrate, until the alkali metal content of the Y-type zeolite is reduced to less than 4 weight percent. The base exchanged zeolite is then calcined at a temperature of 540° C. to 800° C. for up to several hours, cooled and successively base exchanged with an aqueous solution of an ammonium salt until the alkali metal content is reduced to less than 1 weight percent, followed by washing and calcination again at a temperature of 540° C. to 800° C. to produce an ultrastable zeolite Y. The sequence of ion exchange and heat treatment results in the substantial reduction of the alkali metal content of the original zeolite and results in a unit cell shrinkage which is believed to lead to the ultra high stability of the resulting Y-type zeolite.

The ultrastable zeolite Y may then be extracted with acid to produce a highly siliceous form of the zeolite. The acid extraction may be made in the same way as described above for zeolite beta.

Methods for increasing the silica:alumina ratio of zeolite Y by acid extraction are described in U.S. Pat. Nos. 4,218,307, 3,591,488 and 3,691,099, to which reference is made for details of these methods.

Zeolite ZSM-20 may be converted to more highly siliceous forms by a process similar to that used for zeolite Y: first, the zeolite is converted to an "ultrastable" form which is then dealuminized by acid extraction. The conversion to the ultrastable form may suitably be carried out by the same sequence of steps used for preparing ultrastable Y. The zeolite is successively base-exchanged to the ammonium form and calcined, normally at temperatures above 700° C. The calcination should be carried out in a deep bed in order to impede removal of gaseous products, as recommended in Advances in Chemistry Series, No. 121, op cit. Acid extraction of the "ultrastable" ZSM-20 may be effected in the same way as described above for zeolite beta.

Highly siliceous forms of mordenite may be made by acid extraction procedures of the kind described, for example, in U.S. Pat. Nos. 3,691,099, 3,591,488 and other dealuminization techniques which may be used for mordenite are disclosed, for example, in U.S. Pat. Nos. 4,273,753, 3,493,519 and 3,442,795. Reference is made to these patents for a full description of these processes.

Another property which characterizes the zeolites which may be used in the present catalysts is their hydrocarbon sorption capacity. The zeolite used in the present catalysts should have a hydrocarbon sorption capacity for n-hexane of greater than 5 preferably greater than 6 percent by weight at 50° C. The hydrocarbon sorption capacity is determined by measuring the sorption at 50° C., 20 mm Hg (2666 Pa) hydrocarbon pressure in an inert carrier such as helium.

$$\text{Hydrocarbon sorption capacity (\%)} = \frac{\text{Wt. of hydrocarbon sorbed}}{\text{Wt. of zeolite}} \times 100$$

The sorption test is conveniently carried out by TGA with helium as a carrier gas flowing over the zeolite at 50° C. The hydrocarbon of interest e.g. n-hexane is introduced into the gas stream adjusted to 20 mm Hg hydrocarbon pressure and the hydrocarbon uptake, measured as the increase in zeolite weight is recorded. The sorption capacity may then be calculated as a percentage.

The zeolite hydroisomerization catalysts are generally used in a cationic form which gives the required degree of acidity and stability at the reaction conditions used. The zeolite will be at least partly in the hydrogen form, e.g., HZSM-5, HY, in order to provide the acidic functionality necessary for the isomerization but cation exchange with other cations, especially alkaline earth cations such as calcium and magnesium and rare earth cations such as lanthanum, cerium, praseodymium and neodyminum, may be used to control the proportion of protonated sites and, consequently, the acidity of the zeolite. Rare earth forms of the large pore zeolites X and Y, REX and REY, are particularly useful as are the alkaline earth forms of the ZSM-5 type zeolites, such as MgZSM-5, provided that sufficient acidic activity is retained for the isomerization.

Because the isomerization reactions require both acidic and hydrogenation-dehydrogenation functions in the catalyst with a suitable balance between the two functions for the best performance, it may be desirable to use more active hydrogenation components such as platinum with the more highly acidic components; conversely, if the acidic component has but a low degree of acidic activity it may become possible to use a less active hydrogenation component e.g. nickel or nickel-tungsten.

Process Conditions

The feedstock is isomerized over the hydroisomerization catalyst in the presence of hydrogen under isomerization conditions of elevated temperature and pressure. The reaction temperature should be high enough to obtain sufficient isomerization activity but low enough to reduce cracking activity in order to avoid losses in product yield. The temperature will generally be in the range of 200° C. to 450° C. (about 400° F. to 850° F.) and preferably 250° C. to 375° C. (about 480° F. to 705° F.) With the more highly acidic catalysts lower temperatures within these ranges should normally be employed in order to minimize the conversion to lower boiling range products. Reaction pressures (total) are usually from 400 to 25000 kPa (about 50 to 3625 psig), and more commonly in the range of 3500 to 12000 kPa (about 490 to 1725 psig). Space velocities are normally held in the range 0.1 to 10, preferably 0.5 to 5, $hr^{-1}$ LHSV. Hydrogen circulation rates of 30 to 700, usually 200 to 500, $n.l.l.^{-1}$ (168 to 3932, usually 1123 to 2810 SCF/Bbl) are typical. The hydrogen partial pressure will normally be at least 50 percent of total system pressure, more usually 80 to 90 percent or total system pressure.

The isomerization reaction is carried out so as to minimize conversion to lower boiling range products, especially to gas ($C_1$–$C_4$). During the isomerization, the petrolatum wax (slightly branched paraffins and cycloparaffins, generally of at least ten carbon atoms and usually $C_{16}$–$C_{40}$) are converted to branch chain isoparaffins which are more soluble at low temperature. Conversion to lower boiling range products is normally not greater than 10 percent by weight and in favorable cases is less than 5 percent by weight, for example, 3 percent by weight.

The invention is illustrated by the following Examples in which all parts, proportions and percentages are by weight unless the contrary is stated.

EXAMPLES 1–22

Apparatus: A laboratory continuous down-flow reactor was used. It was equipped with feed reservoir and pump, reactor temperature controllers and monitoring devices, gas regulators, flow controller and pressure gauges. Products were discharged into a sample receiver through a grove loader which controlled the operating pressure. Light products were collected in a dry ice cold trap downstream of the sample receiver. Uncondensed gases were first passed through a gas sampler and then NaOH scrubber before passing through a gas meter.

Startup Procedure: The reactor was packed with 10 cc of catalyst. It was activated by passing hydrogen at 370° C. for 2–4 hours with the same $H_2$ circulation rate and pressure as in the projected run. A line out period of 12 hours was followed after the reaction temperature had been set and feeding started.

The operating conditions and catalysts used in the Examples are shown in Table 1 below.

Sample Preparation and Testing procedures: The collected oil product was vacuum stripped at 125° C./0.05 mm Hg (6.7 Pa) for two hours to remove moisture and volatile fractions. The yield was calculated based on the final stripped product. The products were filled in 5.7 cm No. 1 screw capped vials and placed in a refrigerator kept at −1° C. for 16 hours to develop haze.

To evaluate and quantify the degree of cloudiness of each oil product, a set of standards was prepared. These were binary mixtures of a catalytically hydrodewaxed then solvent dewaxed bright stock (this material passed the ONC test) and a hydrodewaxed bright stock (this material failed the ONC test). The mixtures of one component in the other ranged from 0 to 100 percent. Such a set of standards furnished the whole range of cloudiness from 0–100%. The slight dark coloration of the solvent dewaxed oil was removed by percolating it through basic alumina column to obtain the same hue as that of the hydrodewaxed bright stock before it was used in the preparation of the standards.

To grade the clarity-cloudiness of the product oil, both were contained in the same size vial and kept side by side in a refrigerator at −1° C. for 16 hours. The clarity/cloudiness of the product was then matched against the standard. A quality number corresponding to the percent of content of solvent dewaxed oil component in a particular standard was assigned to the oil sample to express its degree of clarity. For example, a number of 80 means that particular oil sample has the same degree of clarity as that of a standard containing 80% solvent dewaxed oil.

The conditions used in the hydroisomerization and the results obtained are shown in Table I below. All runs were conducted at a pressure of 4030 kPa (570 psig).

TABLE 1

| Example No. | Catalyst | Temp. °C. | $H_2$/Charge n.l.l.$^{-1}$ | LHSV | Yield % | Quality |
|---|---|---|---|---|---|---|
| 1 | A | 315 | 178 | 0.82 | — | 20 |
| 2 | A | | 178 | — | — | 40 |
| 3 | A | 345 | 178 | 0.82 | 97.4 | 20 |
| 4 | B | 260 | 356 | 0.53 | 83.6 | 20 |
| 5 | B | 288 | 178 | 1.2 | 90.3 | 30 |
| 6 | B | 345 | 178 | 1.2 | 96.1 | 20 |
| 7 | B | 290 | 178 | 1 | 99.4 | 10 |
| 8 | C | 293 | 178 | 1.1 | 99.1 | 20 |
| 9 | C | 315 | 178 | 0.86 | 97.1 | 10 |
| 10 | C | 345 | 178 | 1.1 | 98.7 | 30 |
| 11 | C | 370 | 178 | 0.95 | 96.9 | 30 |
| 12 | D | 288 | 178 | 1.35 | 95.6 | 40 |
| 13 | D | 315 | 178 | 1.2 | — | 70 |
| 14 | D | 275 | 356 | 0.65 | — | 20 |
| 15 | D | 260 | 356 | 0.61 | — | 30 |
| 16 | D | 260 | 356 | 0.53 | 99 | 50 |
| 17 | D | 315 | 356 | 0.56 | 98 | 50 |
| 18 | D | 345 | 356 | 0.55 | 93.5 | 60 |
| 19 | D | 345 | 356 | 0.47 | 93.9 | 60 |
| 20 | D | 320 | 356 | 0.45 | 99.7 | 70 |
| 21 | D | 293 | 356 | 0.45 | 99.8 | 80 |

TABLE 1-continued

| Example No. | Catalyst | Temp. °C. | $H_2$/Charge n.l.l.$^{-1}$ | LHSV | Yield % | Quality |
|---|---|---|---|---|---|---|
| 22 | D | 370 | 356 | 0.46 | 92.4 | 95 |

Catalysts:
A: $Pt/Al_2O_3$ (0.3% Pt)
B: Pd/HY
C: Pt/Mg Beta/$Al_2O_3$ (0.3% Pt; 50% Mg Beta/50% $Al_2O_3$; Beta $SiO_2/Al_2O_3$ = 100:1)
D: Pd/REY/HZSM-5/$Al_2O_3$ (0.35% Pd; 50% REY/15% HZSM-5, 35% $Al_2O_3$)
The results show that a high degree of improevment in ONC may be achieved by hydroisomerization with little loss in yield.

We claim:

1. A process for improving the overnight cloud point of a catalytically dewaxed lubricating oil stock containing petrolatum wax which is relatively insoluble comprising contacting said oil with a catalyst having both an acidic function and a hydrogenation-dehydrogenation function in the presence of hydrogen at hydroisomerization conditions to produce a product containing branched chain isoparaffins which are more soluble at low temperatures, and wherein the conversion of said oil to lower boiling components is less than about 10 weight percent.

2. A method according to claim 1 in which the hydrogenation component comprises a metal component of Group VIA or VIIIA of the Periodic Table.

3. A method according to claim 1 in which the acidic component comprises a crystalline zeolite.

4. A method according to claim 1 in which the acidic component comprises a large pore zeolite having a Constraint Index of less than 1.

5. A method according to claim 1 in which the acidic component comprises a zeolite having a silica:alumina ratio of at least 12:1 and a Constraint Index of 1 to 12.

6. A method according to claim 1 in which the hydrodewaxed oil is hydroisomerized at a temperature of 200° C. to 450° C., a pressure of 400 to 25000 kPa and a space velocity of 0.1 to 10.

* * * * *